US005998718A

United States Patent [19]

Liao

[11] Patent Number: 5,998,718

[45] Date of Patent: Dec. 7, 1999

[54] BASE DRUM BEATER MOUNTING STRUCTURE

[75] Inventor: Tsun-Chi Liao, Taichung, Taiwan

[73] Assignee: Hwa Shin Instrument Co., Ltd., Taichung, Taiwan

[21] Appl. No.: 09/330,038

[22] Filed: Jun. 11, 1999

[51] Int. Cl.[6] ..... G10D 13/02

[52] U.S. Cl. ..... 84/422.1; 84/422.4

[58] Field of Search ..... 84/411 R, 422.1, 84/422.2, 422.4

[56] References Cited

U.S. PATENT DOCUMENTS

| | | | |
|---|---|---|---|
| 1,360,031 | 11/1920 | Scheurer | 84/422.2 |
| 4,186,644 | 2/1980 | Kurosaki | 84/422.1 |
| 4,691,612 | 9/1987 | Smith | 84/422.1 |
| 4,819,536 | 4/1989 | Lombardi | 84/1.01 |
| 5,398,584 | 3/1995 | Liao | 84/422.1 |
| 5,421,234 | 6/1995 | Liao | 84/422.1 |
| 5,641,924 | 6/1997 | Hsieh | 84/422.1 |
| 5,773,736 | 6/1998 | Hsieh | 84/422.1 |
| 5,895,168 | 4/1999 | Liao | 403/362 |

*Primary Examiner*—Robert E. Nappi
*Assistant Examiner*—Wesley Scott Ashton
*Attorney, Agent, or Firm*—Bacon & Thomas, PLLC

[57] ABSTRACT

A base drum beater mounting structure, which includes a beater having a shank, a mounting base block fixedly fastened to the horizontally extended polygonal shaft of the base drum pedal mechanism of a base drum, the mounting base block having a back opening, a screw hole forwardly extended from the back opening, and two back notches vertically spaced at top and bottom sides of the back opening, which receive the shank of the beater peripherally, a locating block fitted into the back opening at the base mounting block, the locating block having a vertical axle hole, which receives the shank of the beater, and a horizontal screw hole, which is connected between the shank of the beater and the screw hole at the mounting base block by a first tightening up screw, and a counterweight adjustably fastened to the shank of the beater by a second tightening up screw.

5 Claims, 5 Drawing Sheets

BASE DRUM BEATER MOUNTING STRUCTURE

BACKGROUND OF THE INVENTION

The present invention relates to the beater of a base drum, and more specifically to a pedal driven base drum beater mounting structure for a base drum.

A base drum is generally equipped with a beater driven by a pedal driven mechanism. The pedal driven mechanism comprises a shaft, a pedal, a swivel member fixedly connected to the shaft, a chain connected between the pedal and the swivel member, and return spring means for returning the shaft after each pedal stroke. When playing different music, the beater may have to be driven to give different beating force to the face of the base drum. However, because the amplitude of the beater is not adjustable, it is difficult to control the beating force of the beater accurately.

SUMMARY OF THE INVENTION

The present invention has been accomplished under the circumstances in view. It is one object of the present invention to provide a base drum beater mounting structure, which holds the beater firmly in place for positive operation. It is another object of the present invention to provide a base drum beater mounting structure, which enables the amplitude of oscillation of the beater to be conveniently adjusted. To achieve these and other objects of the present invention, there is provided a base drum beater mounting structure, which comprises a mounting base block fixedly fastened to the horizontally extended polygonal shaft of the base drum pedal mechanism of a base drum, a locating block mounted in a back opening at the mounting base block, a tightening up screw fastened to the mounting base block and the locating block to fix the shank of the beater in place, and a counterweight adjustably fastened to the shank of the beater by a tightening up screw.

DETAILED DESCRIPTION OF THE PREFERRED EMBODIMENT

Figure 1:
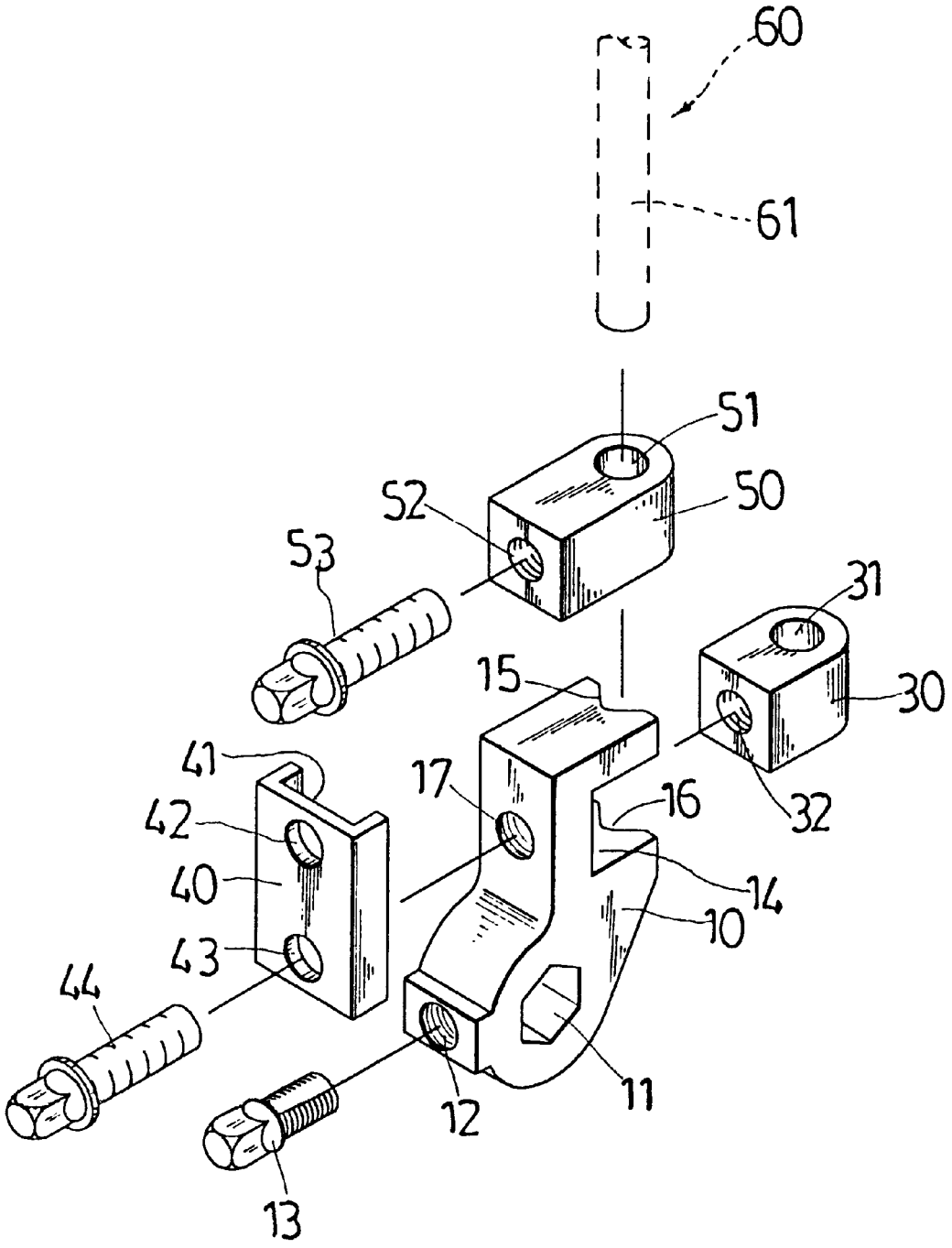
FIG. 1 is an exploded view of the present invention.
Figure 2:
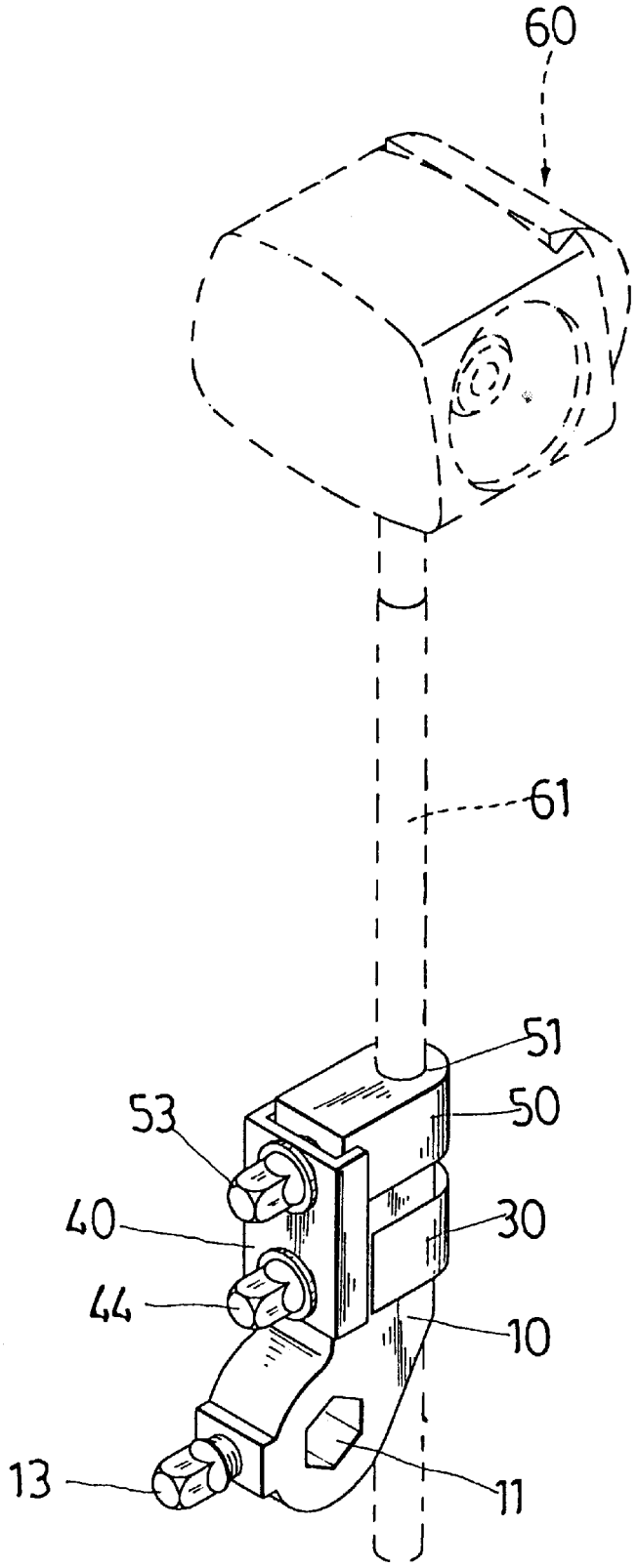
FIG. 2 is an assembly view of the present invention, showing the counterweight fixed to the pressure plate.
Figure 4:
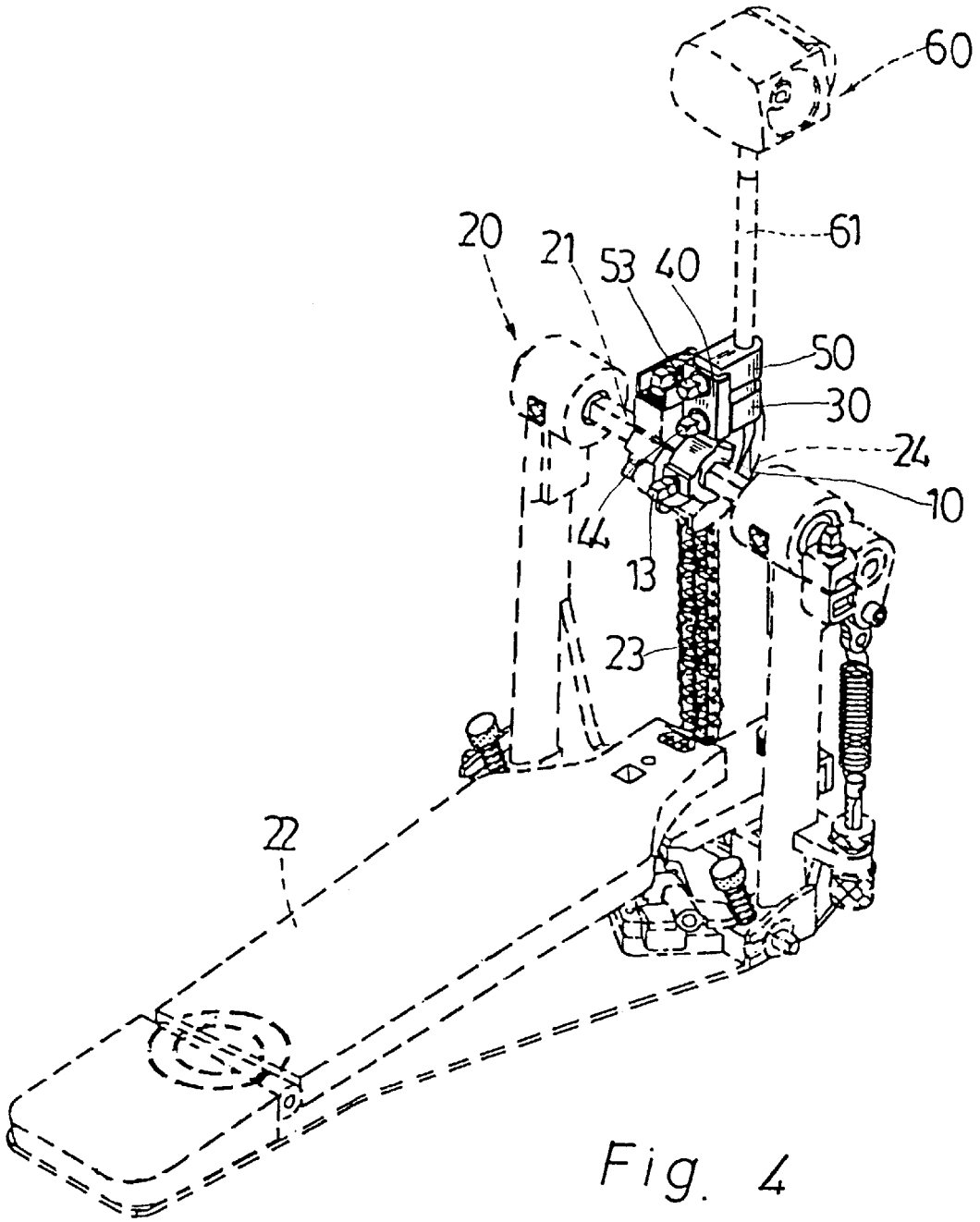
FIG. 4 is an installed view of the present invention, showing the base drum beater mounting structure installed in a base drum pedal mechanism.

Referring to FIGS. 1, 2 and 4, a base drum beater mounting structure in accordance with the present invention is generally comprised of a mounting base block 10, a locating block 30, a pressure plate 40, a counterweight 50, and a beater 60 having a shank 61.

The mounting base block 10 comprises a polygonal mounting hole 11 horizontally disposed at a bottom side and fastened to the polygonal shaft 21 of a base drum pedal mechanism 20, a first screw hole 12 perpendicularly and forwardly extended from the polygonal mounting hole 11 to the front side thereof, a first tightening up screw 13 threaded into the first screw hole 12 to fix the mounting base block 10 to the polygonal shaft 21, a back opening 14 at the back side thereof, two back notches 15 and 16 vertically spaced at the top and bottom sides of the back opening 14, and a second screw hole 17 perpendicularly and forwardly extended from the back opening 14 to the front side.

The locating block 30 fits into the back opening 14 at the mounting base block 10, having a vertical axle hole 31, which receives the shank 61 of the beater 60, and a horizontal screw hole 32 perpendicularly and forwardly extended from the vertical axle hole 31 to the front side thereof and aligned with the second screw hole 17 at the mounting base block 10.

The pressure plate 40 is shaped like a channel bar having a longitudinally extended back channel 41, which receives a part of the mounting base block 10, and two vertically spaced through holes, namely, the upper through hole 42 and the lower through hole 43 respectively and perpendicularly disposed in communication with the back channel 41. The pressure plate 40 is attached to the front side of the mounting base block 10 with its lower through hole 43 set into alignment with the second screw hole 17 at the mounting base block 10, then a tightening up screw 44 is inserted through the lower through hole 43 and threaded into the second screw hole 17 at the mounting base block 10 and the horizontal screw hole 32 at the locating block 30 to fix the mounting base block 10 and the locating block 30 to the shank 61 of the beater 60. When fastening up the tightening up screw 44, the shank 61 of the beater 60 is pulled with the locating block 30 forwardly toward the mounting base block 10, thereby causing the shank 61 to be peripherally and firmly secured to the back notches 15 and 16 at the mounting base block 10.

The counterweight 50 is mounted on the shank 61 of the beater 60, and adjusted to the desired elevation above the mounting base block 10, having a vertical axle hole 51, which receives the shank 61 of the beater 60, and a horizontal screw hole 52 perpendicularly and forwardly extended from the vertical axle hole 51 to the front side thereof. Further, a tightening up screw 53 is threaded into the horizontal screw hole 52 to fix the counterweight 50 to the shank 61 of the beater 60 at the desired elevation.

Referring to FIGS. 2 and 4 again, the counterweight 50 can be closely attached to the mounting base block 10 at the top to secure the shank 61 of the beater 60 to the pressure plate 40. In this position, the tightening up screw 53 is inserted through the upper through hole 42 and then threaded into the horizontal screw hole 52 to hold down the shank 61 of the beater 60.

Figure 3:
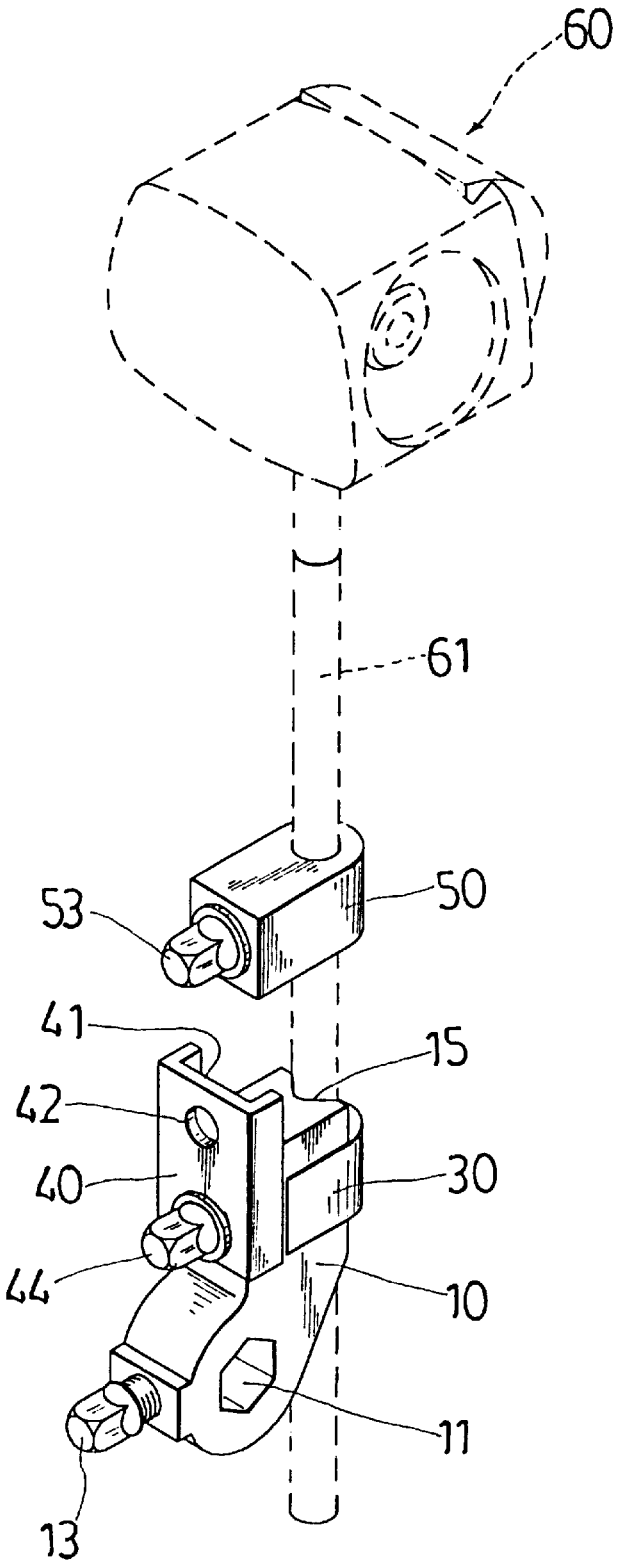
FIG. 3 is similar to FIG. 2 but showing the counterweight disconnected from the pressure plate and fixed to the shank of the beater above the mounting base block.
Figure 5:
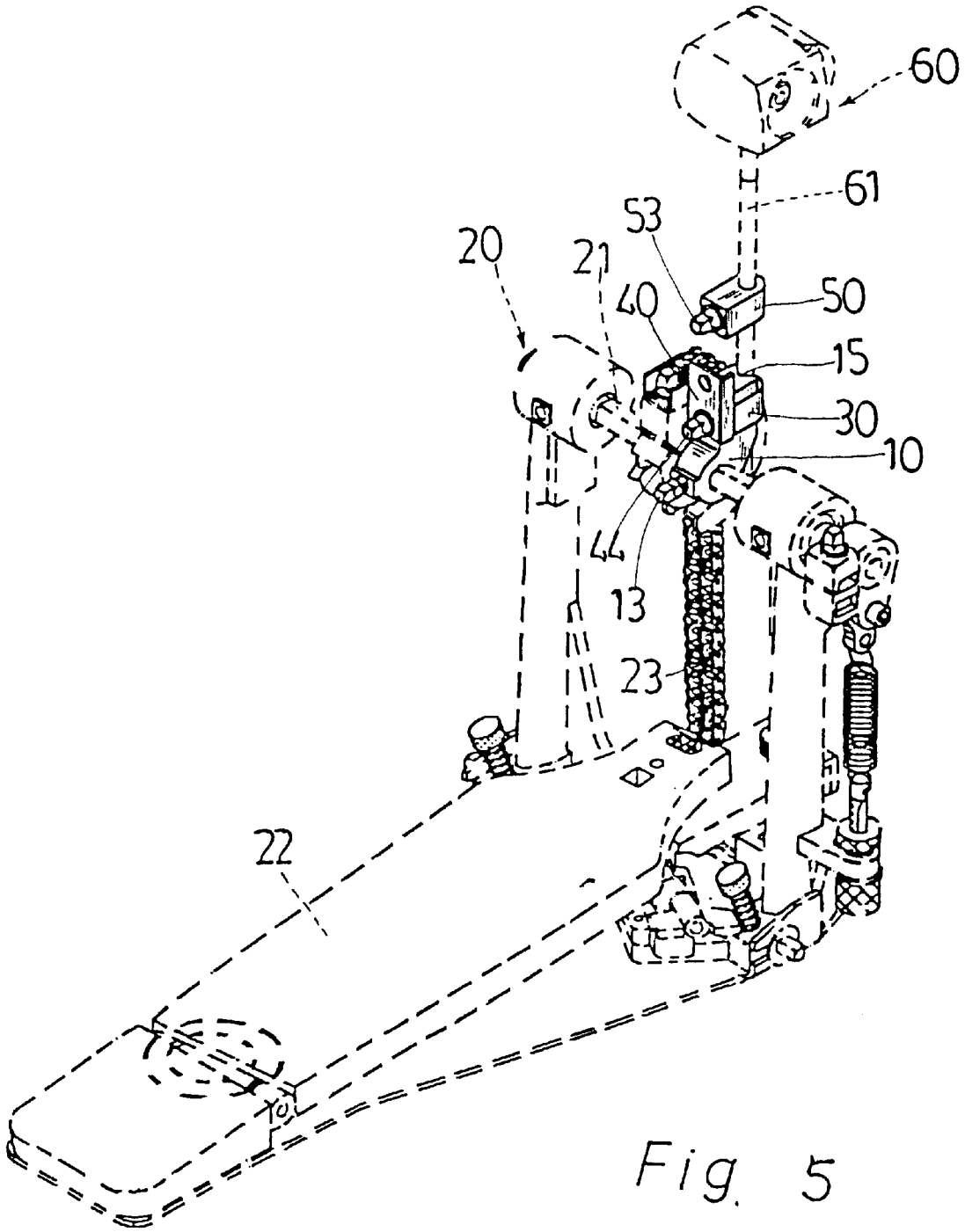
FIG. 5 is similar to FIG. 4 but showing the counterweight disconnected from the pressure plate and fixed to the shank of the beater above the mounting base block.

FIGS. 3 and 5 show the counterweight 50 disconnected from the pressure plate 40 and fastened to the shank 61 of the beater 60 above the mounting base block 10. In this mounting arrangement, the counterweight 50 can be conveniently adjusted to the desired elevation to counterbalance the beater 60. When the drum player operates the pedal 22 of the base drum pedal mechanism 20, the chain 23 is driven to move the swivel block 24, which is fixedly fastened to the polygonal shaft 21, and therefore the beater 60 is turned with the polygonal shaft 21 to beat the face of the base drum (not shown). By adjusting the elevation of the counterweight 50 at the shank 61 of the beater 60, the amplitude of oscillation of the beater 60 is relatively adjusted. Therefore, the drum player can conveniently adjust the beating force by changing the elevation of the counterweight 50 a the shank 61 of the beater 60.

What is claimed is:

1. A base drum beater mounting structure comprising:

a mounting base block fixedly fastened to a horizontally extended polygonal shaft of a base drum pedal mechanism of a base drum;

a beater having a shank fastened to said mounting base block;

a locating block fastened to said mounting base block to secure the shank of said beater in place; and a tightening up screw, which fixes said mounting base block, said locating block and the shank of said beater together; and said mounting base block comprises a back opening and two back notches vertically spaced at top and bottom sides of said back opening for receiving the shank of said beater peripherally, and a screw hole perpendicularly and forwardly extended from said back opening to a front side of said mounting base block; said locating block being fitted into said back opening and fastened to the screw hole at said mounting base block by said tightening up screw to secure the shank of said beater in place; and said locating block has a vertical axle hole which receives the shank of said beater, and a horizontal screw hole perpendicularly extended from said vertical axle hole to a front side of said locating block, wherein said locating block is connected to the screw hole at said mounting base block by said tightening up screw.

2. The base drum beater mounting structure of claim 1 further comprising a pressure plate fastened to the front side of said mounting base block, and a counterweight connected between the shank of said beater and said pressure plate, said pressure plate comprising a lower through hole connected to the screw hole at said mounting base block by said tightening up screw, and an upper through hole disposed above said mounting base block, said counterweight comprising a vertical axle hole, which receives the shank of said beater, and a horizontal screw hole connected between the shank of said beater and the upper through hole at said pressure plate by a second tightening up screw.

3. The base drum beater mounting structure of claim 2 wherein said pressure plate has a longitudinally extended back channel, which receives said counterweight and a part of said base mounting block.

4. The base drum beater mounting structure of claim 1 further comprising a counterweight fastened to the shank of said beater, and a second tightening up screw, which fixes said counterweight to the shank of said beater.

5. The base drum beater mounting structure of claim 4 wherein said counterweight comprises a vertical axle hole, which receives the shank of said beater, and a horizontal screw hole perpendicularly and forwardly extended from the vertical axle hole at said counterweight for the installation of said second tightening up screw.

* * * * *